US005088648A

United States Patent [19]

Schmon

[11] Patent Number: 5,088,648

[45] Date of Patent: Feb. 18, 1992

[54] NOZZLE HEAD FOR A PAINT SPRAY GUN

[75] Inventor: Ewald Schmon, Metzingen, Fed. Rep. of Germany

[73] Assignee: Sata-Farbspritztechnik GmbH & Co., Ludwigsburg, Fed. Rep. of Germany

[21] Appl. No.: 512,316

[22] Filed: Apr. 23, 1990

[30] Foreign Application Priority Data

Jul. 19, 1989 [EP] European Pat. Off. ..... 89113217

[51] Int. Cl.[5] ..... B05B 1/28

[52] U.S. Cl. ..... 239/296

[58] Field of Search ..... 239/290, 296, 291

[56] References Cited

U.S. PATENT DOCUMENTS 2,051,210 8/1936 Gustafsson ..... 239/290

2,204,599 6/1940 Jenkins ..... 239/296

3,848,807 11/1974 Partida ..... 239/296 X

FOREIGN PATENT DOCUMENTS 521511 2/1956 Canada ..... 239/296

*Primary Examiner*—Andres Kashnikow

*Assistant Examiner*—Kevin P. Weldon

*Attorney, Agent, or Firm*—Pascal & Associates

[57] ABSTRACT

In order to largely prevent formation of mist in a nozzle head which is attached to a high-pressure paint spray gun, a small spigot from which the paint issues has a very small thickness of less than 0.5 mm. A circular air jet nozzle which surrounds the spigot and beyond whose outlet area the spigot projects, is provided with a depression which fans out the circular air jet. The circular air jet nozzle is surrounded by a rim of air bores which open to the same annulus as the circular air jet nozzle and which have a smaller total cross-sectional area than the area of the circular air jet nozzle and which produce a rotary air umbrella encircling the circular air jet.

19 Claims, 2 Drawing Sheets

NOZZLE HEAD FOR A PAINT SPRAY GUN

FIELD OF THE INVENTION

This invention relates to a nozzle head for a paint spray gun.

BACKGROUND TO THE INVENTION

Paint spray gun nozzle heads of the type closed by a needle valve are used with high-pressure guns which are operated with compressed air pressure of about 4 bar. This results in very fine spraying of the paint. However a paint mist forms which is harmful to the gun user. The user of these nozzle heads works with high air pressure and a relatively small quantity of air.

In a spray gun known by the name "SATAjet", the circular jet air nozzle of its nozzle head has an outlet area of 2 to 3 $mm^2$ from which the air issues at a high speed, and flows past a small spigot projecting about 0.1 mm beyond the outlet area. Paint from the paint nozzle is thereby drawn and atomized. The finer the spray, the stronger is the mist formation, i.e. the portion of atomized paint which issues from the actual paint jet. The air issuing from the circular jet air nozzle forms a sharply defined circular jet which fans out over a distance from the nozzle head. In the region of the nozzle head, the outside of the circular air jet has a very high speed relative to the ambient air. The paint is accelerated to relatively high speed while being sprayed.

In order to reduce the mist formation, low-pressure guns are used which are operated at an air pressure of 0.7 bar maximum and using a large quantity of air. Low-pressure guns of this type are, for example, the subject of German patent documents DE-A 28 22 650 and DE-A 33 18 204. A common feature of these guns is that the compressed air issuing from the circular jet air nozzle issues at a low pressure and large volume. For this reason, the outlet area of the circular jet air nozzle has an area of about 15 $mm^2$. The paint jet is thereby surrounded by an air cone which, to a great extent, prevents paint mist from being issued. In this case, however, one must put up with only inadequately sprayed paint which reaches the surface to be coated in the form of relatively large drops. Some of these drops leave the spray jet and fall down, which can be clearly seen on paper placed on the floor below the jet.

SUMMARY OF THE INVENTION

It is an object of the invention to design the nozzle head in such a way that mist formation is largely prevented despite generating a fine spray when it is used with a high-pressure spray gun.

The above object is achieved in an embodiment of the invention which is a nozzle head for a paint spray gun comprising a paint nozzle and a nozzle needle for closing the paint nozzle, the paint nozzle having a small spigot. A circular jet air nozzle surrounds the small spigot whereby the small spigot projects therefrom. At least a pair of horn jet air nozzles are diagonally inclined toward the direction of the axis of the paint nozzle. An annulus surrounds the circular jet air nozzle. First air supply bores are connected to the horn jet air nozzles, and extend through the nozzle head to the annulus. Second air supply bores are connected to the circular jet air nozzle. Compressed air is supplied to the air supply bores. A depression is contained in the circular jet air nozzle for producing a conical fanning of circular jet air passing over the paint nozzle. Further air bores extend toward the front of the spray gun from the annulus surrounding the circular jet air nozzle. The outlet area of the circular jet air nozzle is larger by more than 50% than the total cross-sectional area of the further air bores.

The following results from use of the features of the nozzle head of the present invention.

A reduction in mist formation is clearly noticeable, due to the small thickness of the small spigot, since the air issuing from the circular jet air nozzle flows past the spigot largely undisturbed.

By means of a depression, the circular jet air is caused to be already fanned out before the air flows past the nozzle opening of the paint nozzle. The tapered annular circular air jet has, in this case, a high flow velocity on the inside which is advantageous for spraying the paint; the velocity of flow decreases toward the outside of the air cone.

Air bores produce a rotary air umbrella about the circular jet air. The result of the creation of the rotary air umbrella is that the paint droplets which might issue from the jet are conveyed back into the jet. Since the total cross-sectional area of the air bores is smaller than that of the circular jet air nozzle, the energy content of the rotary air umbrella is relatively small, as a result of which its flow velocity is also less. The rotary air umbrella thus functions as a sliding layer between the quick moving atomized jet and the steady ambient air, as a result of which the tangential inflow of ambient air into the atomized jet is largely prevented. Even backlash of paint and/or the lateral escape of paint mist to the object to be coated is visibly reduced due to the rotary air umbrella which holds the jet together.

In accordance with one embodiment, the active nozzle area of the circular jet air nozzle is increased by a factor of 2 to 3 with respect to the nozzle head of a conventional high pressure gun; however it is less by a factor of approximately 3 with respect to a conventional low-pressure gun. As a result of this, the circular jet air volume is increased and, with it, the transition area of moving jet air to the steady ambient air. The premature loss of paint droplets from the jet clearly decreases, since the paint is better encased by air. In connection with the conical fanning out of the circular air jet and, with it, its low flow velocity on the outer periphery, the escape of paint droplets from the jet centre outward is drastically reduced.

Since the total cross-sectional area of the air supply bores extending to the annulus is almost equal to the total cross-sectional area of the circular jet air nozzle and the air bores, a reduction of the flow velocity is attained in the circular air jet and rotary air umbrella with respect to the nozzle head with a high-pressure gun.

The result of selecting as noted above the total cross-sectional area of the horn jet air nozzles is that the energy content and velocity of the air flowing out of these nozzles is greater than that of a high-pressure gun. A powerful wide jet is thus obtained.

Due to the recessed arrangement of the air bores relative to the circular jet air nozzle, a rotary air umbrella is already formed when the air issuing from the air bores strikes the outside of the circular air jet. Providing two variably steep truncated conical areas between the circular jet air nozzle and the rim of air bores prevents paint droplets from flowing in the direction of the air bores due to a suction effect at the air bores.

When using this nozzle head in a high-pressure gun, the paint is finely sprayed, mist formation is largely prevented and the escape of paint droplets from the jet centre toward the outside is clearly reduced. The nozzle head, therefore, has the advantages of nozzle heads in high and low-pressure guns, but avoids their disadvantages.

BRIEF INTRODUCTION TO THE DRAWINGS

An embodiment of the invention is described in greater detail below with reference to the following drawings, in which.

DETAILED DESCRIPTION OF A PREFERRED EMBODIMENT

Figure 1:
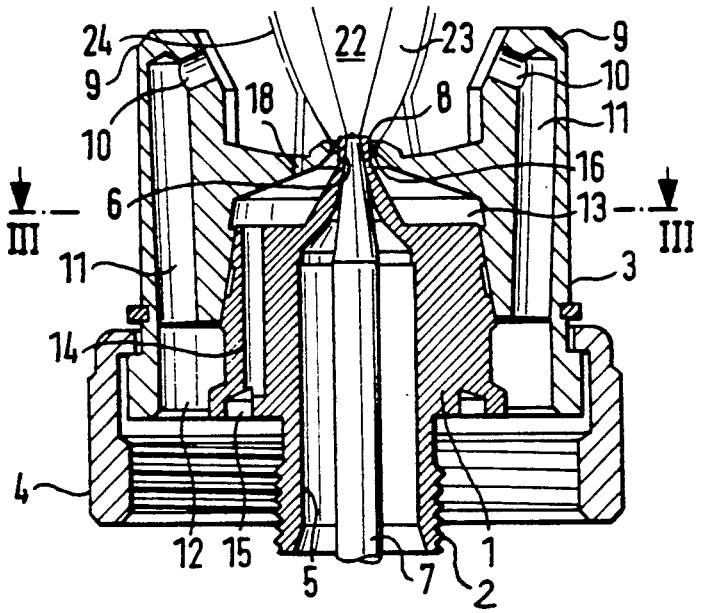
FIG. 1 is a section through the nozzle head.
Figure 2:
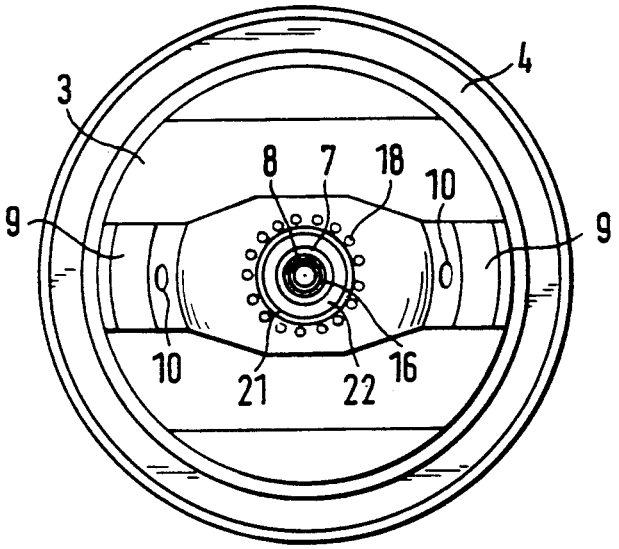
FIG. 2 is a front view of the nozzle head.
Figure 3:
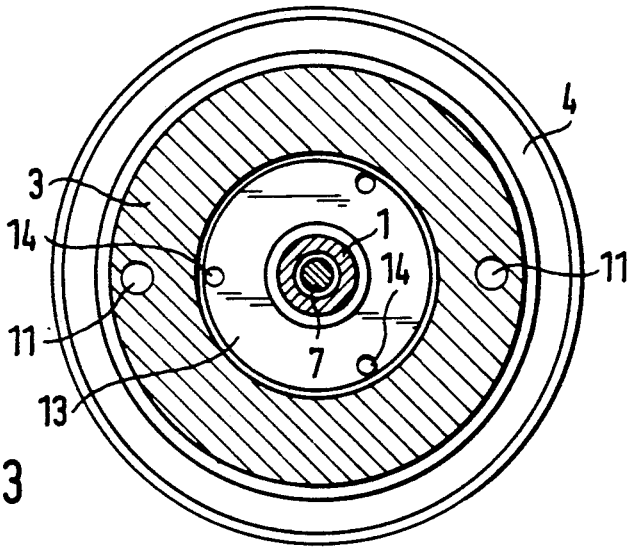
FIG. 3 is a section along the line A-A in FIG. 1.
Figure 4:
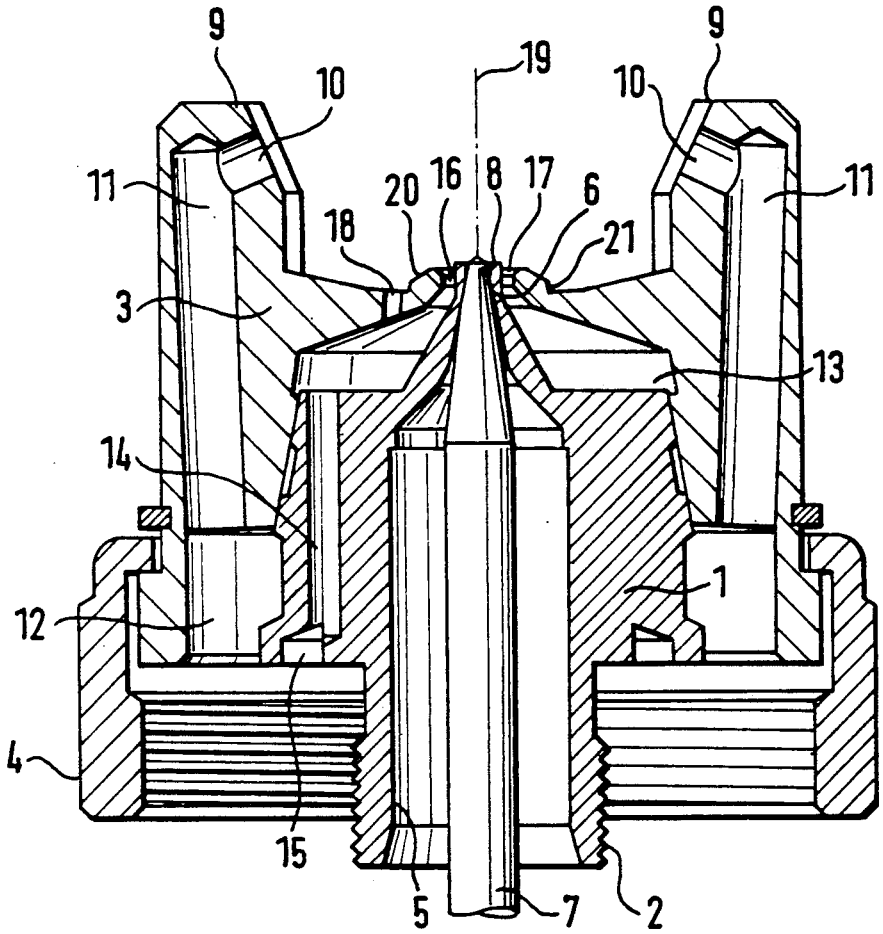
FIG. 4 is an enlarged illustration of the nozzle head of FIG. 1.

The nozzle head of the paint gun has a paint nozzle head 1 which can be connected to the paint spray gun via a thread 2. The paint nozzle head 1 is surrounded by an air nozzle head 3 which can also be connected to the paint spray gun via a screw cap 4. The paint nozzle head 1 has a central bore 5 which passes over into a conical paint nozzle 6 which can be closed by a nozzle needle 7. The paint nozzle head 1 ends with a circular cylindrical small spigot 8.

Air nozzle head 3 has two diametrically opposed horns 9 which each have a horn jet air nozzle 10. These horn jet air nozzles 10 are connected to air supply bores 11 which extend through the air nozzle head 3 and open to an annular chamber 12 which is formed between paint nozzle head 1 and air nozzle head 3. At the front, an annulus 13 is formed between paint nozzle head 1 and air nozzle head 3; three air supply bores 14 extend through paint nozzle head 1 to the annulus 13. The air supply bores 14 open to a further annular chamber 15 at the back of the paint nozzle head 1.

Air nozzle head 3 has a central bore surrounding small spigot 8, as a result of which a circular jet air nozzle 16 is formed between spigot 8 and the central bore. The bore on the air nozzle head side of the circular jet air nozzle 16 is provided with an outwardly divergent depression 17 on the outside. Small spigot 8 projects outwardly beyond the outlet area of the circular jet air nozzle 16.

Circular jet air nozzle 16 is surrounded by a rim of air bores 18. These air bores open to annulus 13. The air bores 18 are convergently inclined in the direction of the jet axis 19. In the illustrated embodiment, the inclination is 10°. The outlet orifices of the air bores 18, are recessed relative to the outlet areas of the circular jet air nozzles 16. Two truncated conical regions are provided between the outer edge of the circular jet air nozzle 16 and the rim of air bores 18, namely, a flat truncated conical area 20 on the inside and, adjacent thereto, a steep truncated conical area 21. The inclination of the truncated conical area 20 to the horizontal line is about 30°.

In the illustrated embodiment, a total of 17 air bores 18 are provided which each have a diameter of 0.5 mm. The thickness of the small spigot 8 is less than 0.5 mm; its projection beyond the outlet area of the circular jet air nozzle 16 is preferably 0.3 mm. circular jet air nozzle 16 has an area of about 5.5 $mm^2$ at its narrowest point. Thus, it is about 1.6 times larger than the total cross-sectional area of the air bores 18. The total cross-sectional area of the three air supply bores 14 is about the same as the total cross-sectional area of air bores 18 plus the cross-sectional area of the circular jet air nozzle 16. The total cross-sectional area of the two horn jet air nozzles 10 is about the same as the total cross-sectional area of circular jet air nozzle 16 and air bores 18.

As can be seen in FIG. 1, a conical spray area 22 of the paint coming out of the paint nozzle 6 results. Due to depression 17, the circular jet 23 fans out before it reaches the paint spray area 22 and thus has a velocity gradient which decreases greatly from the inside out. A rotary air umbrella 24 produced by the air bores 18, which has an even smaller velocity than the outer area of circular jet 23, then strikes the outer area of circular jet 23. Thus the intake of ambient air in the area of circular jet 23 is safely avoided. The result of the small thickness of the spigot 8 and its projection beyond the outlet area of the circular jet air nozzle 16 is that mist formation is, to a great extent, prevented. The speed variation within the circular jet and rotary air umbrella, seen from the inside out, prevents paint droplets from the spray area reaching the outside.

I claim:

1. A nozzle head for a paint spray gun comprising, (a) a paint nozzle, (b) a nozzle needle for closing the paint nozzle, the paint nozzle having a small spigot, (c) a circular jet air nozzle surrounding the small spigot whereby the small spigot projects therefrom, (d) at least a pair of horn jet air nozzles diagonally inclined toward the direction of the axis of the paint nozzle, (e) an annulus surrounding the circular jet air nozzle, (f) first air supply bores connected to the horn jet nozzles extending through the nozzle head to the annulus, circular jet air nozzle, (h) means for supplying compressed air to the air supply bores, (i) a depression contained in the circular air jet nozzle for producing a conical fanning of circular jet air passing over the paint nozzle, (j) further air bores extending toward the front of the spray gun from the annulus surrounding the circular jet air nozzle, and (k) the outlet area of the circular jet air nozzle being larger by more than 50% than the total cross-sectional area of the further air bores.

2. A nozzle head as defined in claim 1, in which the thickness of the small spigot is less than 0.5 mm.

3. A nozzle head as defined in claim 1, in which the small spigot projects approximately 0.3 mm beyond the outlet area of the circular jet air nozzle.

4. A nozzle head as defined in claim 2, in which the small spigot projects approximately 0.3 mm beyond the outlet area of the circular jet air nozzle.

5. A nozzle head as defined in one of claims 1–4, in which the outlet area of the circular jet air nozzle is between two and three times larger than a nozzle head of a conventional high-pressure gun and about three times smaller than a nozzle head of a low-pressure gun.

6. A nozzle head as defined in one of claims 1–4, in which the outlet area of the circular jet air nozzle is approximately 5.5 $mm^2$ in size.

7. A nozzle head as defined in one of claims 1–4, in which the further air bores are convergently inclined in the direction of the jet axis.

8. A nozzle head as defined in claim 7, in which the convergent inclination is about 10°.

9. A nozzle head as defined in one of claims 1–4, in which the further air bores are greater than 10 in number.

10. A nozzle head as defined in claim 5, in which the further air bores are greater than 10 in number.

11. A nozzle head as defined in one of claims 1–4, in which said first bores extending to the annulus have a total cross-sectional area which is approximately equal to the total cross-sectional area of the circular jet air nozzle and the further air bores.

12. A nozzle head as defined in one of claims 1–4, in which the total cross-sectional area of the horn jet air nozzles is approximately equal to the total cross-sectional area of the circular jet air nozzle and of the further air bores.

13. A nozzle head as defined in one of claims 1–4, in which the further air bores are recessed relative to the circular jet air nozzle, and a flat truncated conical surface toward the front of the nozzle head and a more rearward steep truncated conical surface adjacent thereto are disposed between the outer edge of the circular jet air nozzle and the rim of the further air bores.

14. A nozzle head as defined in claim 7, in which said first bores extending to the annulus have a total cross-sectional area which is approximately equal to the total cross-sectional area of the circular jet air nozzle and the further air bores.

15. A nozzle head as defined in claim 7, in which the total cross-sectional area of the horn jet air nozzles is approximately equal to the total cross-sectional area of the circular jet air nozzle and of the further air bores.

16. A nozzle head as defined in claim 11, in which the total cross-sectional area of the horn jet air nozzles is approximately equal to the total cross-sectional area of the circular jet air nozzle and of the further air bores.

17. A nozzle head as defined in claim 7, in which the further air bores are recessed relative to the circular jet air nozzle, and a flat truncated conical surface toward the front of the nozzle head and a more rearward steep truncated conical surface adjacent thereto are disposed between the outer edge of the circular jet air nozzle and the rim of the further air bores.

18. A nozzle head as defined in claim 11, in which the further air bores are recessed relative to the circular jet air nozzle, and a flat truncated conical surface toward the front of the nozzle head and a more rearward steep truncated conical surface adjacent thereto are disposed between the outer edge of the circular jet air nozzle and the rim of the further air bores.

19. A nozzle head as defined in claim 12, in which the further air bores are recessed relative to the circular jet air nozzle, and a flat truncated conical surface toward the front of the nozzle head and a more rearward steep truncated conical surface adjacent thereto are disposed between the outer edge of the circular jet air nozzle and the rim of the further air bores.

* * * * *